United States Patent [19]

Poll

[11] Patent Number: 4,571,836

[45] Date of Patent: Feb. 25, 1986

[54] PANTOGRAPH

[76] Inventor: Marian Poll, 1271 N.W. Hwy., Park Ridge, Ill. 60068

[21] Appl. No.: 709,296

[22] Filed: Mar. 7, 1985

[51] Int. Cl.[4] ..... B43L 13/10

[52] U.S. Cl. ..... 33/25 B; 33/23 H; 33/27.12

[58] Field of Search ..... 33/25 B, 25 R, 25 D, 33/23 R, 23 E, 23 H, 23 K, 27 R, 27 K, 30 R, 30 B

[56] References Cited

U.S. PATENT DOCUMENTS

| | | | |
|---|---|---|---|
| 669,549 | 3/1901 | Roche | 33/25 B |
| 2,032,350 | 3/1936 | Burnett et al. | 33/25 D |
| 3,376,646 | 4/1968 | Radke | 33/25 B |
| 4,221,052 | 9/1980 | Wagoner | 33/25 B |

*Primary Examiner*—Willis Little

[57] ABSTRACT

A drafting instrument for tracing ellipses and other curves adapted for the use with templates of such curves, comprising a set of links pivotally connected at each end, and disposed in parallel to constitute two pairs of opposite sides of rhombus link mechanism. The rhombus link mechanism carries in one vertex a needle point for piercing a graphic surface on which a curve is to be retraced for free pivotal movement of the mechanism about this center. Stem secured in other opposite vertex for being constrained along a cutout edge of a template. Two sliding members are respectively supported in grooves on the pair of opposite links. Said slide members are linked together for correlated movement, therein. A stylus guide member is supported by the link for tracing the curve on the graphic surface.

2 Claims, 10 Drawing Figures

PANTOGRAPH

FIELD OF INVENTION

The present invention relates to pantographs, more specifically, it relates to the type designated to work in combination with templates for ellipses or other curves.

SUMMARY AND OBJECT OF THE INVENTION

According to the present invention, a complete ellipse, or other curve, or parts thereof, may be traced by the use of templates of the curves in combination with the mechanism comprising a set of links pivotally connected at each end, disposed in parallel to constitute two pairs of opposite rhombus link mechanism. The rhombus link mechanism carries in one vertex a needle point for piercing a graphic surface for free pivotal movement of the mechanism about this center. A stem secured in other opposite vertex is for being constrained along a cutout edge of the template. Two sliding members are respectively supported on a pair of opposite links, linked together for correlated movement, therein. And stylus guide member is supported by the links.

The advantages of the instant invention are its simplicity of construction and its particular ease of use, thereby affording a device which is relatively cheap and quite accurate. These advantages are not simultaneously present in any prior art instrument.

The invention will be more readily understood and other objects and advantages will become apparent from the study of the following portion of this application, the claims and the attached drawings, in which:

Figure 1:
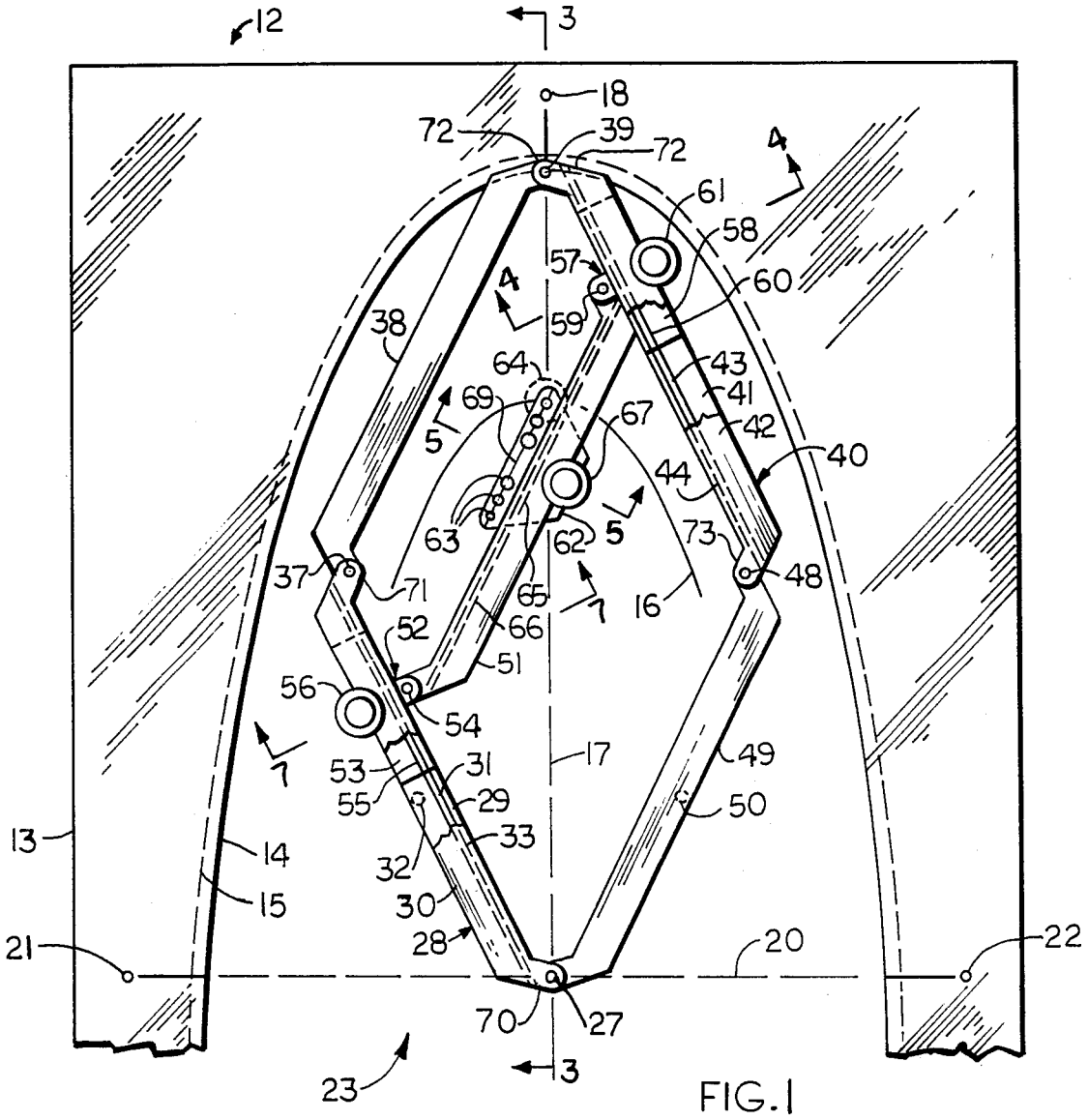
FIG. 1 is a top plan view showing one application of the instrument in which a reduced ellipse may be drawn from a given ellipse template.
Figure 2:
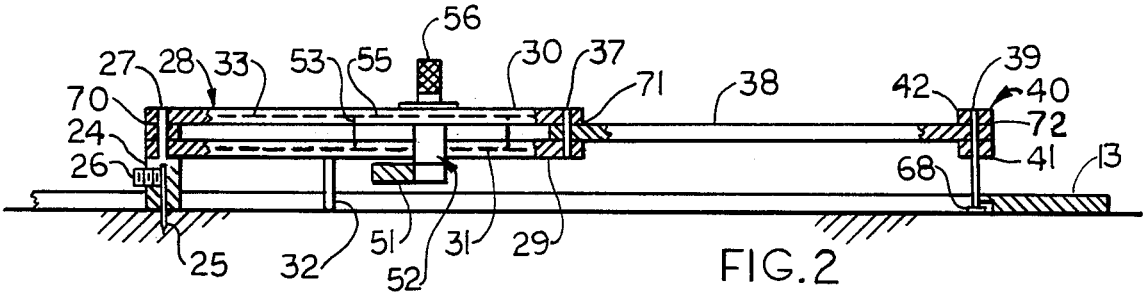
FIG. 2 is a sectional view taken on line 3—3 in FIG. 1.
Figure 3:
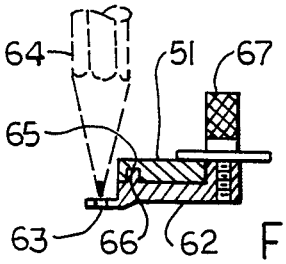
FIG. 3 is a sectional view taken on line 5—5 in FIG. 1.
Figure 4:
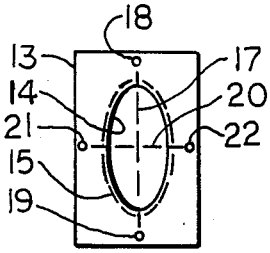
FIG. 4 is integral, reduced top plan view of the template.
Figure 5:
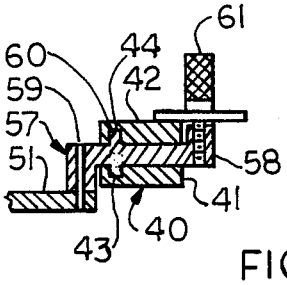
FIG. 5 is a sectional view taken on line 4—4 in FIG. 1.

Referring to the drawings, the instrument for tracing ellipses and other curves is designated in entirety by 12. It comprises a plate 13, preferably, rectangular in shape, and, preferably, made of transparent plastic. Plate 13 has an elliptical cutout 14. The inner edge of the cutout 14 is formed with reces 15 to receive stem disc 68. For visual alignment of the plate 13 with the axis of the curve 16 to be drawn, in the plate 13, on the major axis line 17, provided are holes 18 and 19. On the minor axis line 20 provided are holes 21 and 22.

The instrument also comprises a needle point support 24 and articulated linkage 23. Needle point support 24, having at the center of its lower end needle point 25, engaging table at the center of the curve, is secured to the support by screw 26, and at its upper end, at its center, pivot pin 27.

C-shaped, slide supporting link 28 of the linkage 23 has lower flat portion 29, upper flat portion 30 spaced above and extending out over the lower portion and clevis-shaped ends 70 and 71. Lower portion 29 is formed in its upper surface with groove 31, on its lower surface with leg 32. Upper portion 30 is formed in its lower surface with a lengthwise groove 33. Groove 31 is in line with groove 33 and parallel to a straight line joining centers of pin 27 and 37. Said slide supporting link 28 is pivotally connected through clevis 70 to the said needle point support 24, by means of pivot pin 27 and through clevis 71 to first end of bare link 38, by means of pin 37. Bare link 38 is pivotally connected at its second end to slide supporting link 40, through clevis 72, by means of stem 39. Said stem 39 is projected downwardly, having at its distal end disc 68. Said stem 39 is constrained along cutout edge 14. Said link 40 has lower flat portion 41 and upper flat portion 42 spaced above and extending out over the lower portion and clevis-shaped ends 72 and 73. Lower portion 41 is formed in its upper surface with lengthwise groove 43; and upper portion 42 is formed in its lower surface with lengthwise groove 44. Groove 43 is in line with groove 44 and parallel to a straight line joining centers of stem 39, and pivot pin 48. Said link 40 is pivotally connected through clevis 73 to first end of link 49 by means of pivot pin 48. Bare link 49, formed with leg 50 on the lower surface, is pivotally connected at its second end to said support 24, through clevis 70, by means of pivot pin 27.

A transverse link 51 is mounted parallel to opposite links at its first end to the link 28, through an articulated joint 52. The joint 52 comprises a sliding member 53, pivotally mounted on the transverse link 51, by the pivot pin 54, and is formed with a fin 55, that is slideably mounted in grooves 31 and 33, between lower and upper portion and the sliding member is secured at a selected point on the link 28, by means of a thumb screw 56. The center of the pivot pin 54 is on a straight line joining centers of the pins 27 and 37. The second end of the transverse link is mounted on the link 40, through an articulated joint 57. The joint 57 comprises a sliding member 58 pivotally mounted on the link 51 by the pivot pin 59, and formed with a fin 60, that is slideably mounted in grooves 43 and 44 between lower and upper portion 41 and 42. And the sliding member is secured on the link 41, by means of the thumb screw 61. And, because the sliding members slide in unison, the transverse link will always move parallel to opposite links; so the selected location of one sliding member corresponds to the location of the other sliding member. The center of said pivot pin 59 is on a straight line joining centers of pins 39 and 48. A stylus guide member 62, suitably shaped, having plurality of holes 63 spaced on hair line 69, along a straight line joining centers of pins 54 and 59, wherein the holes are each of a diameter to receive respective stylus 64, which is to trace a curvilinear path 16 over the graphic surface. The tracing element 64 may be a pencil, pen, or, other suitable marking device. The stylus guide member 62 is formed with a fin 65 that is slideably mounted in groove 66 and is freely displaceable on the link 51 and can be fixedly secured at any particular location by means of a thumb screw 67.

Figure 6:
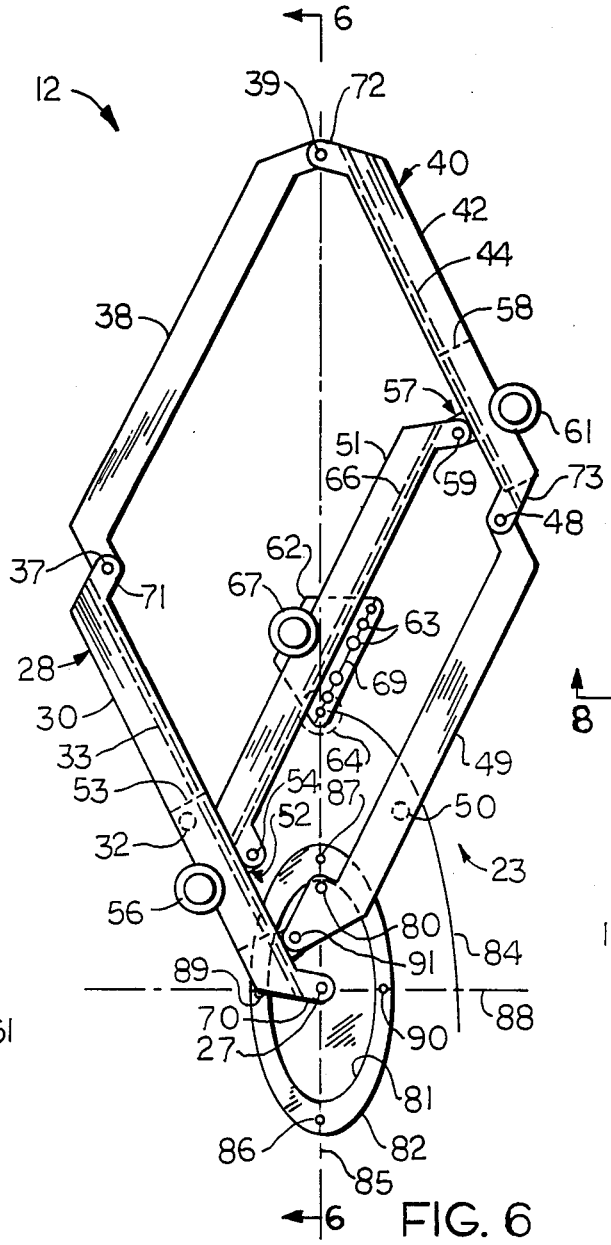
FIG. 6 shows in plan a modification and another application of the instrument, according to the invention; in which an enlarged ellipse may be drawn from a given ellipse template.
Figure 9:
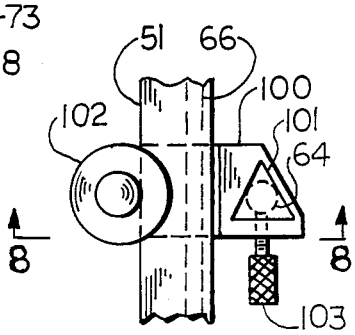
FIG. 9 is a top plan view of an auxiliary stylus guide member according to the invention.

FIG. 6 shows a modification of the links 28, 41, 49, and, template 82. With this modification, enlarged curves may be retraced from given template. Link 49 is pivotally connected at its distal end to the shortened link 40, through clevis 73, by means of pivot pin 48; and with its proximal end is pivotally connected on the lower portion of link 28, by means of pivot pin 91. Said pin 91 is on the straight line joining centers of pins 27 and 37. And said link 49 is provided with the stem 80 on a straight line joining center of pivot pin 27 and stem 39. Stem 80 is restrained along cutout edge 81 of the template 82. Template 82 is, preferably, elliptical in shape, and is, preferably, made of transparent plastic. Said template 82 has a blind elliptical cutout 81 with a hole 83 at its center to receive needle point 25. For visual alignment of template 82, with the axis of curve 84 to be drawn by stylus 64 over its major axis 85, provided are holes 86 and 87. Over its minor axis 88, provided are holes 89 and 90. Said template is mounted to graphic surface by drafting tape.

Figure 8:
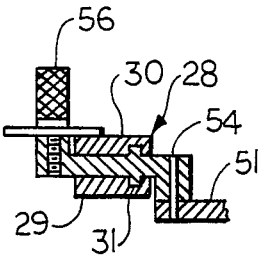
FIG. 8 is a sectional view taken on line 7—7 in FIG. 1.
Figure 10:
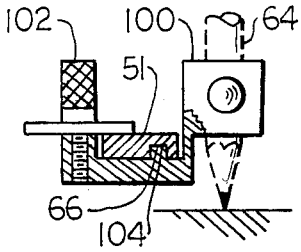
FIG. 10 is a sectional view taken on line 8—8 in FIG. 9.
Figure 7:
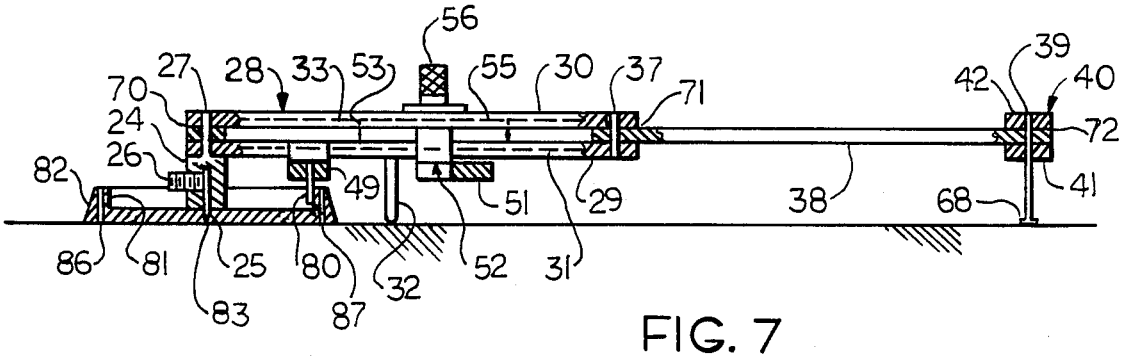
FIG. 7 is a sectional view taken on line 6—6 in FIG. 6.

As shown in FIG. 8, an auxiliary-interchangeable stylus holder 100 is included, having triangular hole 101, to receive stylus 64, which is secured in, by thumb screw 102. The hole 101 being with its vertex on the straight line joining centers of pivot pin 54 and 59, and with its base perpendicular to that line. The said stylus holder, formed with fin 104 that is slideably mounted in groove 66, and is freely displaceable on the link 51, can be fixedly secured at any particular location by means of a thumb screw 102.

As shown in FIG. 1, with the instrument one can trace any ellipse from the first ellipse. The first ellipse will be provided by the elliptical cutout edge 14 in the plate 13. With the stem 39, constrained along said elliptical cutout 13, and thereby the second reduced elliptical curve 16 will be coaxically retraced by the stylus 64. And as shown in FIG. 6, any ellipse can be traced from a first ellipse, provided by the elliptical cutout 81 in the template 82, with the stem 80 constrained along said elliptical edge 81, the second enlarged elliptical curve 84 will be coaxically retraced by the stylus 64.

The way in which the instrument is used may be briefly described as follows:

Place template 13 on graphic surface in such a manner as to cause the holes 18 and 19 to rest on the major axis line 17 and holes 21 and 22 to rest on the minor axis line 20 and secure the template on graphic surface with a drafting tape. Introduce the needle point 25 into the graphic surface at the intersection of the two axes of the ellipse for free pivotal movement of the instrument about this center. Bring stem 39 in contact with edge 14 at the point where the edge 14 intersects with the major axis 17. With the thumb screws 56, 61 and 67, loosened, bring the stylus guide member 62 with respective hole 63 directly over the mark on the major axis line that indicates the length of the major axis. Tighten thumb screw 56, 61, and, 67. With the stylus 64, introduced into the suitable hole 63, swung through its full travel, the ellipse 16 is traced. Modified instrument operates as follows:

Place template 82 on graphic surface in such a manner as to cause the hole 86 and 87 to rest on the major axis 85 and hole 89 and 90 to rest on the minor axis line 88. Secure the template on the graphic surface with a drafting tape. Introduce the needle 25 into the hole 83 at the intersection of the two axes of the ellipse for free pivotal movement of the instrument about this center. Bring stem 80 in contact with edge 81 at the point where the edge 81 intersects with major axis 85. With the thumb screw 56, 61 and 67 loosened, bring the stylus guide membe 62 with suitable hole 63 directly over the mark on the major axis line that indicates the length of the major axis. Tighten thumb screw 56, 61 and 67. With the stylus 64 swung through its full travel an ellipse 84 is traced.

While preferred embodiments according to the present invention have been illustrated and described, it is understood that various modifications may be resorted to without departing from the spirit and scope of the appended claims.

What I claim is:

1. A drafting instrument for tracing ellipses and other curves, adapted for the use with suitable templates of such curves, said templates having a recess at its cutout edges to receive a stem disc to prevent upward movement of the instrument, said instrument comprising left and right C-shaped slide supporting links, left and right C-shaped bare links whose one ends are pivotally connected to said left slide supporting link and whose other ends are pivotally connected to said right slide supporting link, said left and right slide supporting links and said left and right bare links are of equal length and being disposed in parallel to constitute two pairs of opposite sides of rhombus link mechanism having first and opposite second vertexes, a needle point support secured to said link mechanism in said first vertex and a stem secured in said second opposite vertex, said stem being constrained along the cutout edge of a template and a pair of linkage supporting legs, said rhombus link mechanism also includes means for guiding a stylus, said means including two sliding members respectively supported in the slide supporting links, designed to be secured at any selected point therein, a transverse C-shaped link pivotally connected at each end to said sliding members and interchangeable stylus guide member supported by said transverse link, designed to be secured to said link at any selected point for manual guiding said stylus along a curvilinear path for retracing said curve on the graphic surface.

2. A drafting instrument as in claim 1 which includes another stem mounted on a proximal end of a bare link adjacent to the said needle point support, said stem is on a straight line joining centers of needle point and distal stems, to be constrained along edge of a cutout of a template, said template having a blind elliptical cutout, and a hole in the end wall at center of the cutout to receive needle point.

* * * * *